US006843877B2

(12) United States Patent
Risi

(10) Patent No.: US 6,843,877 B2
(45) Date of Patent: Jan. 18, 2005

(54) WOOD FLOORING FOR USE IN MAKING TRAILER AND CONTAINER FLOORS, AND METHOD AND APPARATUS FOR MAKING THE SAME

(75) Inventor: Benoit Risi, Ste-Foy (CA)

(73) Assignee: Prolam, Societe en Commandite, Quebec (CA)

( * ) Notice: Subject to any disclaimer, the term of this patent is extended or adjusted under 35 U.S.C. 154(b) by 0 days.

(21) Appl. No.: 10/186,125

(22) Filed: Jun. 28, 2002

(65) Prior Publication Data

US 2003/0037873 A1 Feb. 27, 2003

Related U.S. Application Data

(60) Provisional application No. 60/303,072, filed on Jul. 6, 2001.

(51) Int. Cl.[7] ..... B27D 1/00; B27D 3/00

(52) U.S. Cl. ..... 156/304.5; 156/304.6; 144/347; 144/348; 144/352

(58) Field of Search ..... 156/304.1, 304.5, 156/304.6; 144/347, 348, 350, 352, 355, 90.1, 91, 90

(56) References Cited

U.S. PATENT DOCUMENTS

| | | | | |
|---|---|---|---|---|
| 3,262,723 A | | 7/1966 | Strickler | 287/20.92 |
| 3,927,705 A | * | 12/1975 | Cromeens et al. | 144/347 |
| 4,095,634 A | * | 6/1978 | Berglund et al. | 144/347 |
| 4,128,119 A | | 12/1978 | Maier | 144/317 |
| 4,294,647 A | * | 10/1981 | Strickler | 156/558 |
| 4,543,765 A | * | 10/1985 | Barrett | 52/747.11 |
| 4,624,295 A | | 11/1986 | Howland | 144/347 |
| 4,731,140 A | * | 3/1988 | Yontrarak | 156/154 |
| 4,931,113 A | * | 6/1990 | Feichtmeir et al. | 156/64 |
| 4,938,265 A | | 7/1990 | Mountz | 144/347 |
| 5,117,603 A | * | 6/1992 | Weintraub | 52/390 |
| 5,679,191 A | | 10/1997 | Robinson | 156/64 |
| 5,928,735 A | | 7/1999 | Padmanabhan et al. | 428/33 |
| 5,930,967 A | | 8/1999 | Stoehr et al. | 52/403.1 |
| 6,025,053 A | | 2/2000 | Grenier | 428/172 |
| 6,082,421 A | * | 7/2000 | Nicol et al. | 144/90.1 |
| 6,089,297 A | * | 7/2000 | Shibagaki et al. | 156/558 |
| 6,135,531 A | | 10/2000 | Allen et al. | 296/39.1 |
| 6,179,942 B1 | | 1/2001 | Padmanabhan | 156/153 |
| 6,183,824 B1 | | 2/2001 | Padmanabhan et al. | 428/33 |
| 6,189,682 B1 | * | 2/2001 | Hill | 198/718 |

* cited by examiner

*Primary Examiner*—Sue A. Purvis
(74) *Attorney, Agent, or Firm*—Merchant & Gould P.C.

(57) ABSTRACT

An apparatus and method for simultaneously pressing together longitudinally a plurality of individual strips of wood, each strip being provided with a finger joint at each end. The strips are jointed end to end in a number of rows to form a floorboard. The apparatus includes a mechanism for simultaneously applying longitudinal pressure to each of the rows of wood strips during the curing process. The resulting floorboard is mechanically improved, has greater protection against humidity and increases the fatigue resistance of the floorboard, which can be used for trailer floors or the like.

1 Claim, 19 Drawing Sheets

(12 of 19 Drawing Sheet(s) Filed in Color)

WOOD FLOORING FOR USE IN MAKING TRAILER AND CONTAINER FLOORS, AND METHOD AND APPARATUS FOR MAKING THE SAME

FIELD OF THE INVENTION

The present invention relates to an improvement in hardwood-based laminated wood flooring used in truck trailers and containers. A novel joint design and a new assembly technique are used together with usual techniques of wood laminating in the production of truck trailers floors. The application of this technique improves the mechanical properties, the protection against humidity and the fatigue resistance.

DESCRIPTION OF THE PRIOR ART

Conventional wood flooring for over-the-road truck trailers and containers is normally manufactured with hardwoods such as oak, maple, birch, beech, etc. The green lumber used as a starting material in such manufacture is suitably dried in special drying chambers under controlled conditions. The dried lumber is then sawed into strips of rectangular cross-section and defective portions are eliminated by cross cutting the strips. After, with a double end matching or during the cross cutting process, <<hooks>> are formed at the ends of the lumber strips. The relatively defect-free lumber strips are coated on their vertical sides or edges with an adhesive such as urea-melamine formaldehyde or polyvinyl acetate. The uncured edge-glue lumber strips are then assembled by hand on a conveyor by placing them side-by-side and one in front of other strips, which were previously assembled. Applying heat and edge pressure to large sections of the assembled lumber strips cures the adhesive thus forming a unitary panel. Other means of curing the adhesive are also known.

The joints are a simple mechanical coupling between the mating hook ends of opposing lumber strips without significant adhesive bonding at the joint itself. The <<hook joint>> (see FIG. 1, identified as prior art) is necessary in the present manufacturing process because it links every strip the one in front and behind, the one at the front pulling on the back (FIG. 2). In this respect, the hook joint helps pull the strips through the manufacturing process, and is not structural. Often, due to imperfect assembly (FIG. 3) or because the hook breaks easily (FIGS. 4*a* and 4*b*), a readily visible gap is formed at the hook joint, which can be seen from the top and bottom surfaces of the finished laminated wood floor (FIGS. 5*a* and 5*b*). These opened joints, which can traverse the floor entirely, must be repaired, usually with putty. However, this repair does not obviate the risk of water leaking through.

The manual assembly of the strips is a very important element and is essential to reach the desired mechanical properties of the floor and meet industrial requirements. In fact, the persons that assemble the strips must 1) minimise the number of joints by square foot and 2) maximise the space between joints in a way that it is equalised all over the wood surface (FIGS. 6*a* and 6*b*). These two elements maximise the floor's mechanical support and the durability.

At the output of the press, the cured laminated wood is cut to a desired length (up to about 60 feet) and width (about 6 to 18 inches) to form boards. The boards are then planed to a desired thickness and shiplaps and crusher beads are machined on the sides. A shiplap is a rectangular projecting ledge along the length on each side of a floorboard. The crusher bead is a small semi-circular projection running along the length on each side of a board and placed over or below a lip (FIG. 7). When the floorboards are assembled in a trailer such that the side edges of corresponding boards are squeezed together, the shiplaps of adjacent boards overlap to form a seam. The crusher beads provide spacing between adjacent boards and help in preventing buckling of the boards due to expansion of the board following absorption of water. Wood putty is applied at the hook joints on the top and bottom surfaces of the boards to fill any gaps. Finally, the underside of the floorboards is coated with a polymeric substance termed as "undercoating" to provide moisture protection. The finished floorboards are assembled into a kit of about eight boards for installation in a trailer. Normally, a kit consists of two boards with special shiplaps so that they will fit along the road and curb sides of a trailer. The other boards may be identical in design and they are placed between the road and curb sideboards. In some trailers, a metallic component such as a hat-channel may be placed between any two adjacent boards. The metallic component becomes part of the floor area. The boards adjacent the hat-channel have machined edges designed to mate with the flanges of the metallic component. All the boards are supported by thin-walled cross-members of I, C or hat sections, each having an upper flange or surface, which span the width of the trailer and are spaced along the length of the trailer. Each floorboard is secured to the cross-members by screws or other appropriate fastener extending through the thickness of the board and the upper flanges of the cross-members.

Hardwood-based laminated wood flooring is popularly used in truck trailers since it offers many advantages. The surface characteristics of hardwoods such as high wear resistance and slip resistance are most desirable. The strength and stiffness of the flooring is important for efficient and safe transfer of the applied loads to the cross-members of the trailer. The shock resistance of wood is useful to withstand any sudden dropping of heavy cargo on the floor. Nail holding capability and the ability to absorb small amounts of water, oil or grease without significantly affecting slip resistance are yet additional favourable properties of hardwood flooring.

Although the conventional wood flooring has many desirable features, it also suffers from certain disadvantages. One of the problems is the hook joint at the end of each stick. The design of the hook joint is not optimal for a trailer floor for two principal reasons.

Firstly, water from the road is known to leak into trailers through the hook joints. The reasons the water can leak into the joint are that during the production of the floor, there is not enough longitudinal pressure to ensure that all the hook joints are tightly closed. This lack of pressure sometimes creates small gaps which can extend through the floor, allowing water to leak into the trailer. Furthermore, during the assembling of the strips of wood, the assembler may not assemble the sticks properly, breaking the hook or leaving a gap between two strips through which water can penetrate. Finally, the design of the hook joint is not optimal to properly prevent water from entering by capillarity into the joint. Although the undercoating is supposed to provide a barrier to the path of water, it may not properly cover larger gaps, thus exposing them to moisture. Wetting and drying cycles can degrade the undercoating leading to its cracking and peeling away from the wood. Over time, the action of the shrinkage and the swelling at the end of the strip will create the start of a failure in the line of glue along the glue line between strips. Over the time, the floor will lose is initial strength and stiffness, gradually reducing its integrity.

Secondly, each hook joint in a trailer floor is mechanically a weak spot due to the shape of the hook. This reduces the capacity of the floor to react properly to the dynamic action of a moving lift truck placing heavy cargo into the trailer. A lift truck is often used on the trailer floor to load and unload cargo. A large amount of the weight of the lift truck and the cargo is transferred to the flooring through the wheels of the front axle of the lift truck due to the momentary raising of the rear axle when the lift truck is dynamically placing a heavy cargo on the floor. The dynamic action of a moving lift truck placing heavy cargo on the trailer floor creates severe stress concentration in the flooring and some of the cross-members. Bending of the floor between two adjacent cross-members due to any applied load on the top of the floor has a tendency to open the hook joints and enlarge the gaps. Additionally, because of the design of the hook joint, the capacity of the load transfer is optimal only in one direction of the floor, not the other direction. The effect of repeated lift truck operation on the conventional wood floor causes considerable fatigue damage including: delamination of the edge glued lumber strips near the hook joints leading to the "pop-out" of the lumber strips on the underside; crack initiation and propagation in the wood strips on the underside of the floor due to tensile stresses; and cracking of edge glue lines due to shearing, transverse bending and twisting of the floor. The combination of moisture attack and fatigue damage to the wood floor affects its performance thus necessitating its repair or replacement. In some cases, catastrophic structural failure of the trailer floor system may occur leading to the unacceptable injury to working personnel and damage to machinery.

SUMMARY OF THE INVENTION

It is an object of the present invention to provide a method and apparatus for making a floorboard, and a resulting floorboard, which improves the mechanical properties, the protection against humidity and the fatigue resistance of a floorboard.

In accordance with the invention, these and other objects are achieved with a floorboard comprising a plurality of elongated wood strips of unequal lengths assembled end to end and side by side, each side being coated with an adhesive, said wood strips being cured together to form said floorboard, each wood strip having two opposite ends, each opposite end being provided with spaced apart fingers so that when two strips of wood are joined end to end, the fingers of a wood strip engage with the fingers of another wood strip.

In another aspect, the invention concerns an apparatus for making a floorboard comprising:

a conveyor belt;

an assembly area located at a first portion on the conveyor belt for receiving elongated strips of wood and for assembling said strips of wood end to end and side by side in rows to form a floorboard, said wood strips being longitudinally interconnected with each other with a finger joint;

a press located at a second portion on the conveyor belt, downstream from said assembly area, for receiving said floorboard, said press being provided with lateral pressure means for exerting lateral pressure on said floorboard and a plate movable between a retracted position and a pressing position and with a stop for stopping a leading end of the floorboard;

holding means;

means for applying longitudinal pressure on said wood strips when said floorboard is in said press;

an output area located at a third portion on the conveyor belt, downstream from said curing area, for receiving said cured floorboard said output area being provided with a holder for holding a portion of said floorboard extending beyond said press; and a controller for controlling operation of said apparatus.

In a preferred embodiment of the invention, said means for applying longitudinal pressure are a multi-finger joint pressing machine located at the entrance of the curing area, said multi-finger joint pressing machine including a transversal support bar being movable between a retracted position and an operative position, said support bar being provided with a plurality of fingers extending under the support bar and longitudinally towards the output area, whereby when said support bar is in said retracted position, said floorboard can be conveyed into said curing area, and when said support bar is in said operative position, said fingers engage a top portion of said floorboard in order to apply downward and longitudinal pressure to said wood strips and thereby force said finger joints to close.

The invention also concerns a method for making a floorboard.

DESCRIPTION OF THE FIGURES

This patent or application file contains at least one drawing executed in color. Copies of this patent or patent application publication with color drawing(s) will be provided by the Office upon request and payment of the necessary fee.

The present invention will be better understood from reading a description of a preferred embodiment thereof made in reference to the following drawings in which:

FIG. 10*a* is a rear perspective view; FIG. 10*b* is a top view of the input of the press; FIG. 10*c* is a partial front perspective view; and FIG. 10*d* is a front elevational view;

DESCRIPTION OF THE PREFERRED EMBODIMENT

Figure 1:
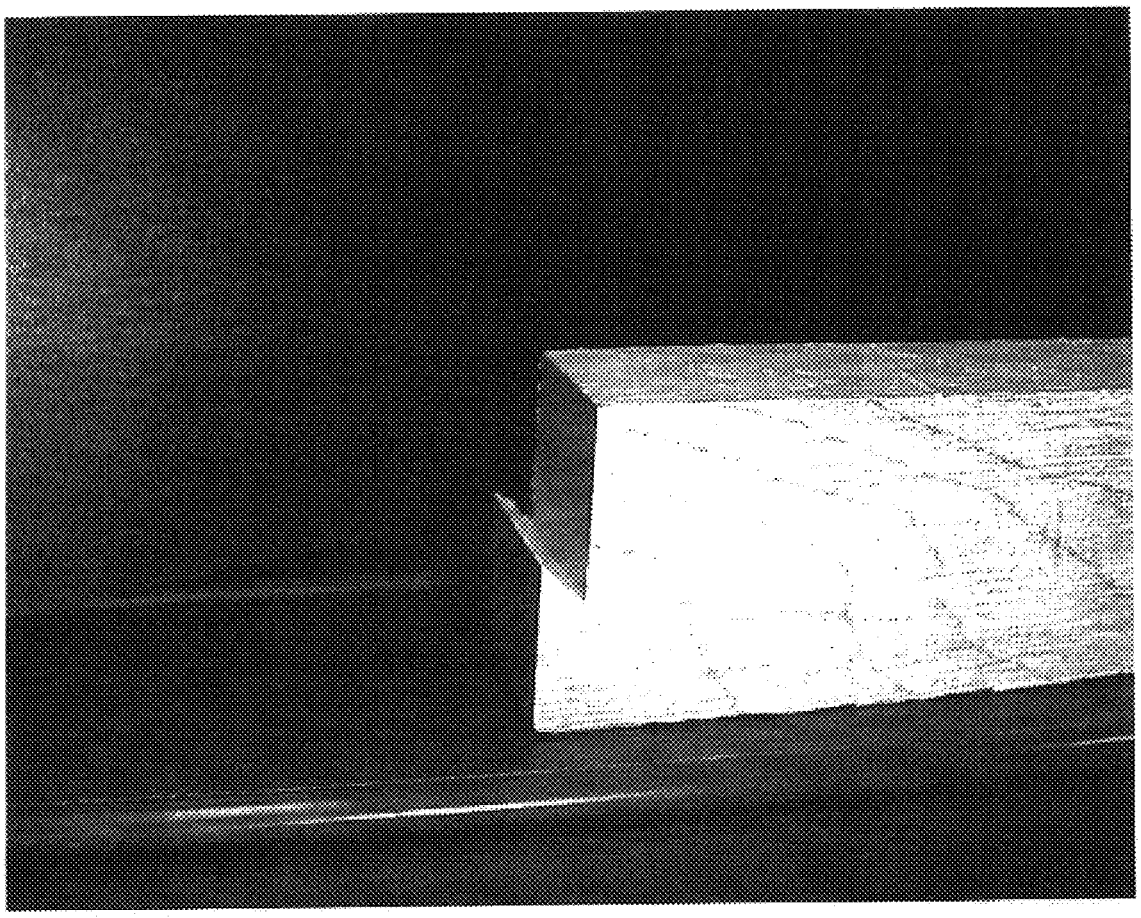
FIGURE 1 (PRIOR ART)
FIG. 1, identified as Prior Art, is a photograph showing a hook joint used in the hardwood trailer floor industry.
Figure 2:
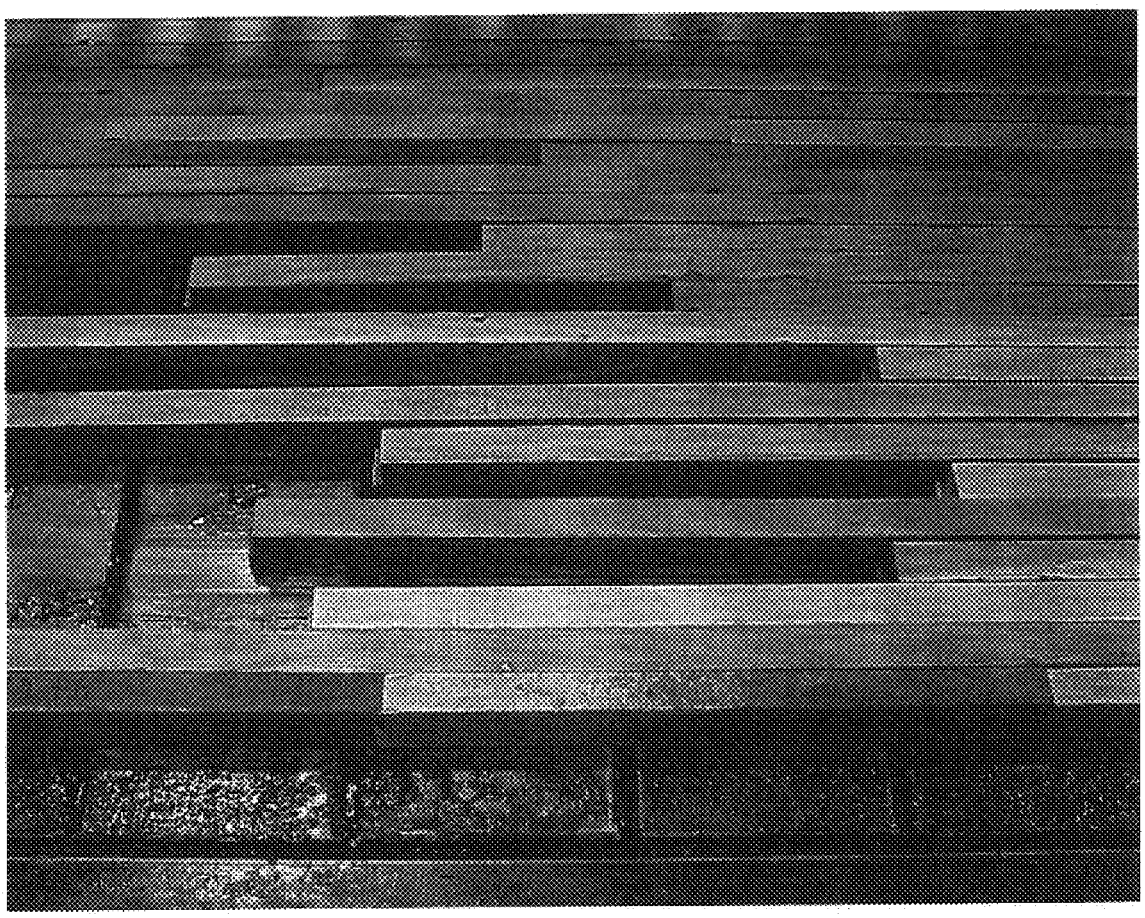
FIGURE 2 (PRIOR ART)
FIG. 2, identified as Prior Art, is a photograph showing wood strips on the conveyor at the entry of the press.
Figure 3:
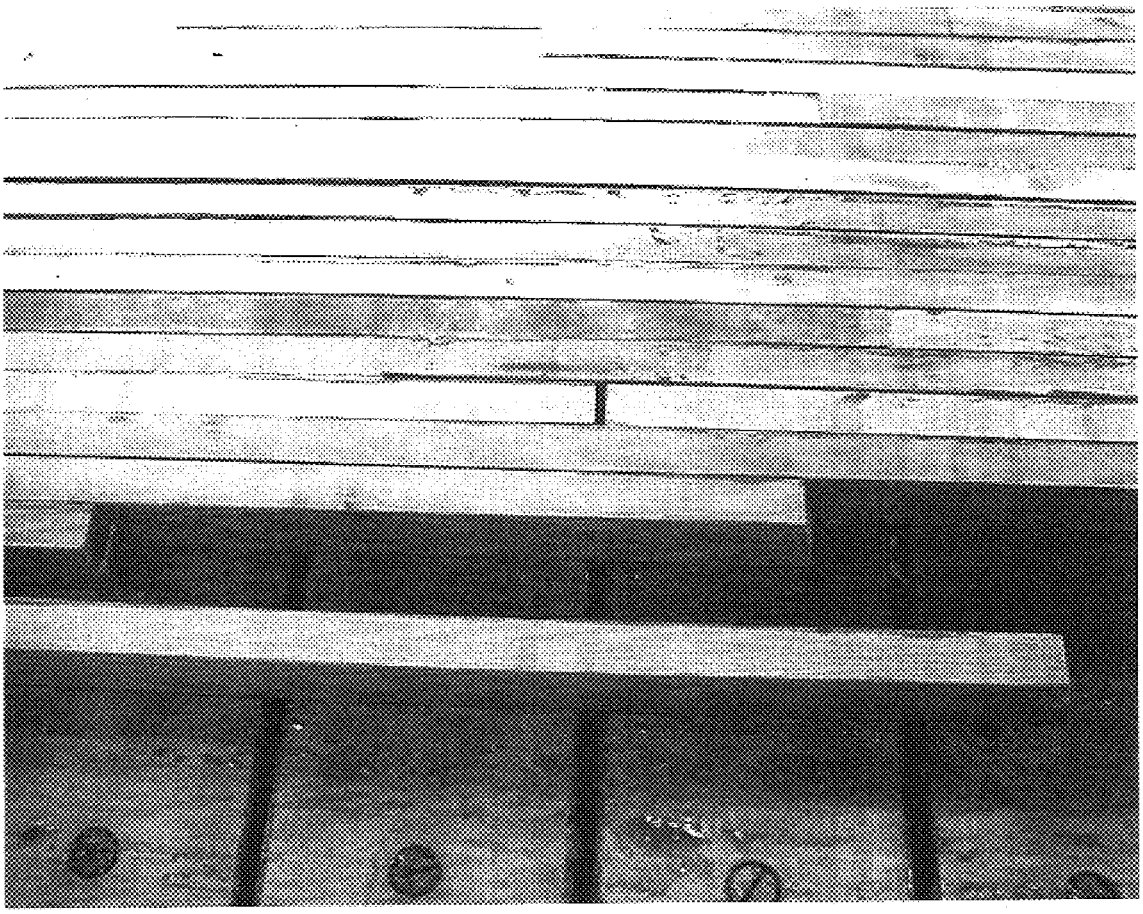
FIGURE 3 (PRIOR ART)
FIG. 3, identified as Prior Art, is a photograph showing an example of an imperfect assembly at the entry of the press.
Figure 4A:
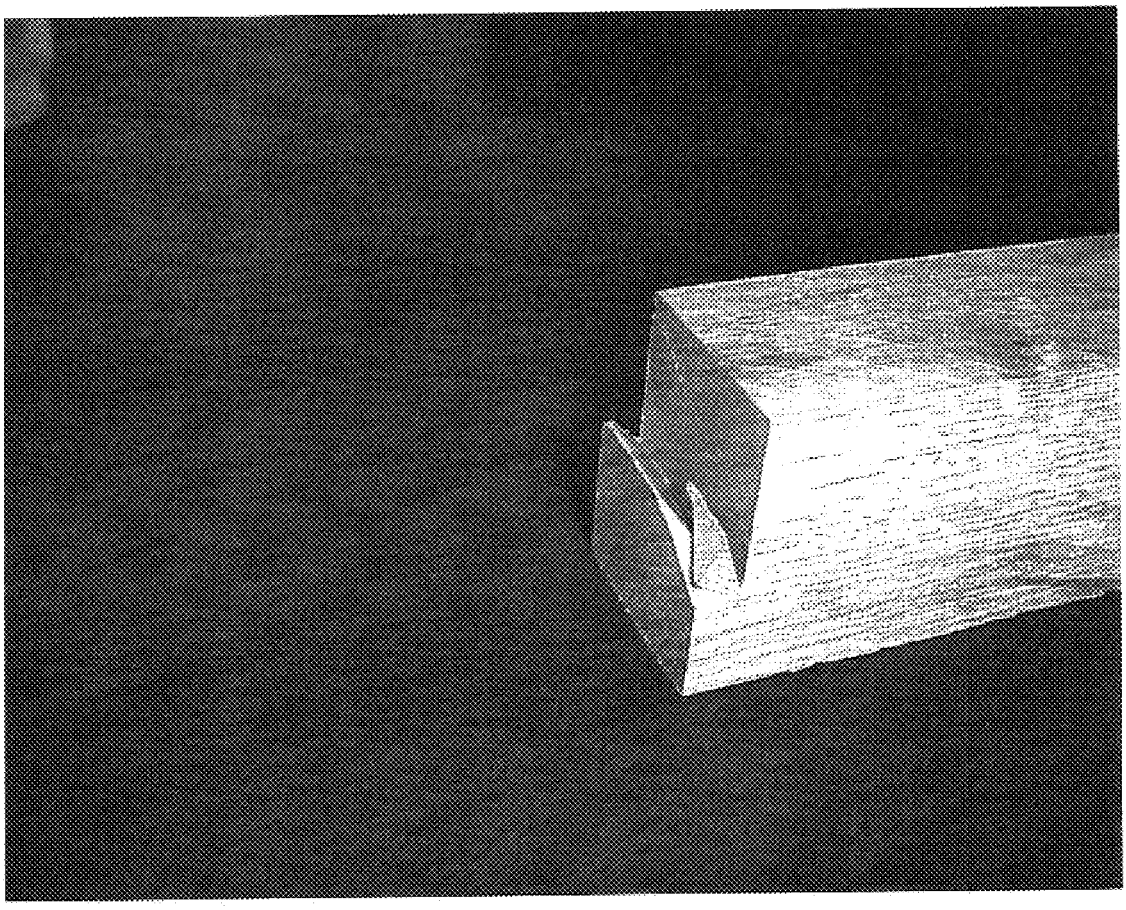
FIGURE 4a (PRIOR ART)
FIGS. 4*a* and 4*b*, identified as Prior Art, are photographs showing broken hook joints.
Figure 4B:
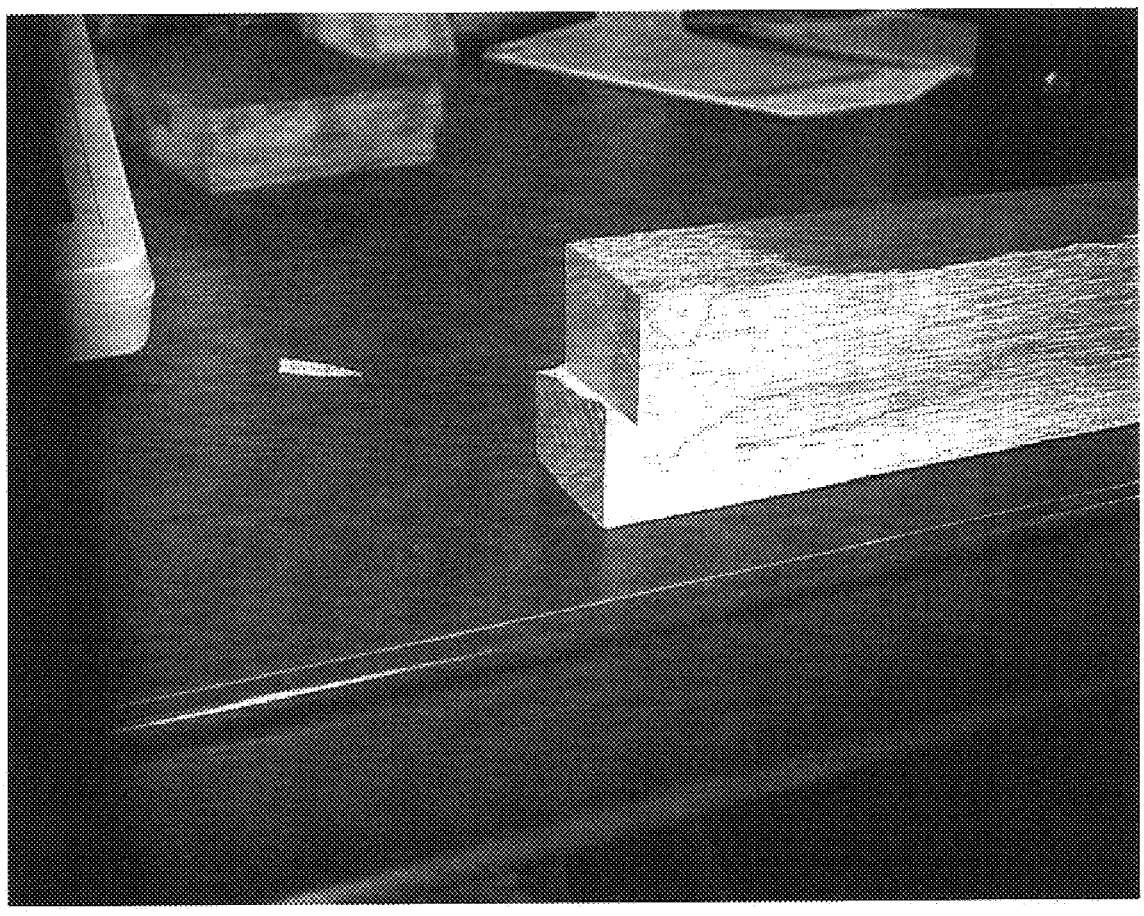
FIGURE 4b (PRIOR ART)
Figure 5A:
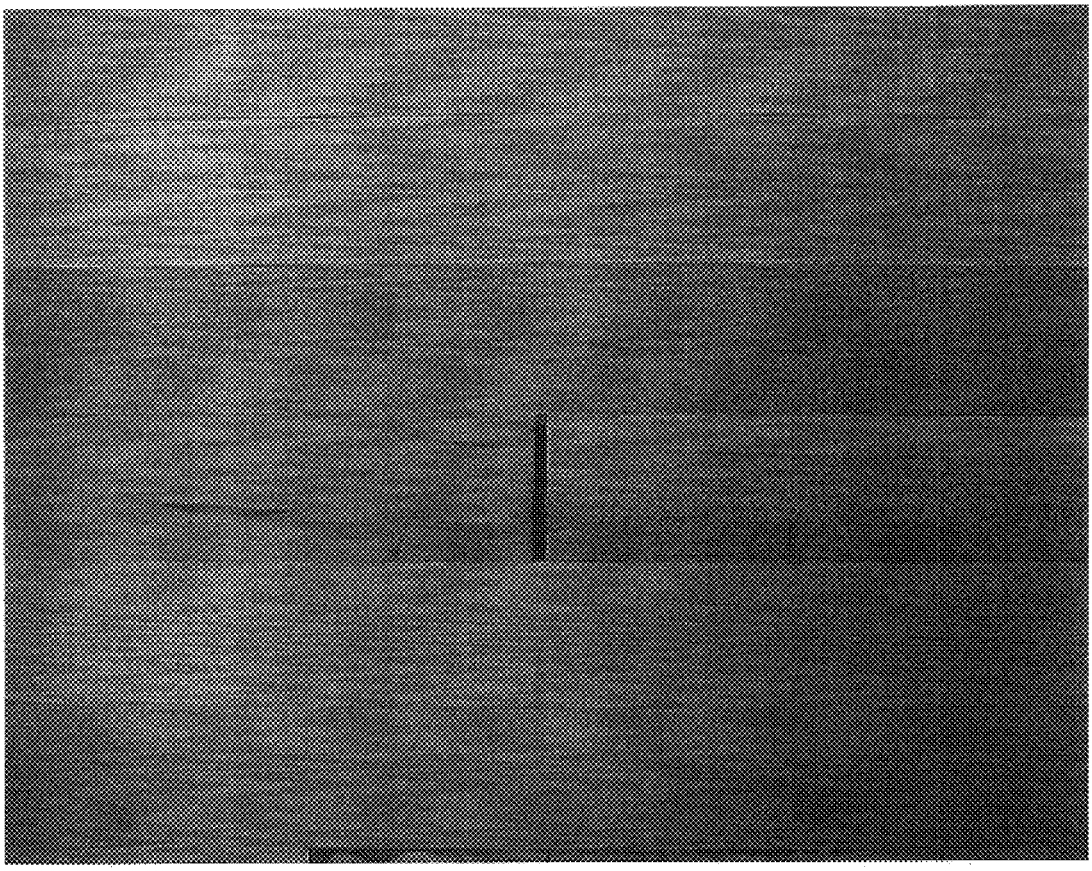
FIGURE 5a (PRIOR ART)
FIGS. 5*a* and 5*b*, identified as Prior Art, are photographs showing gaps between two strips of wood.
Figure 5B:
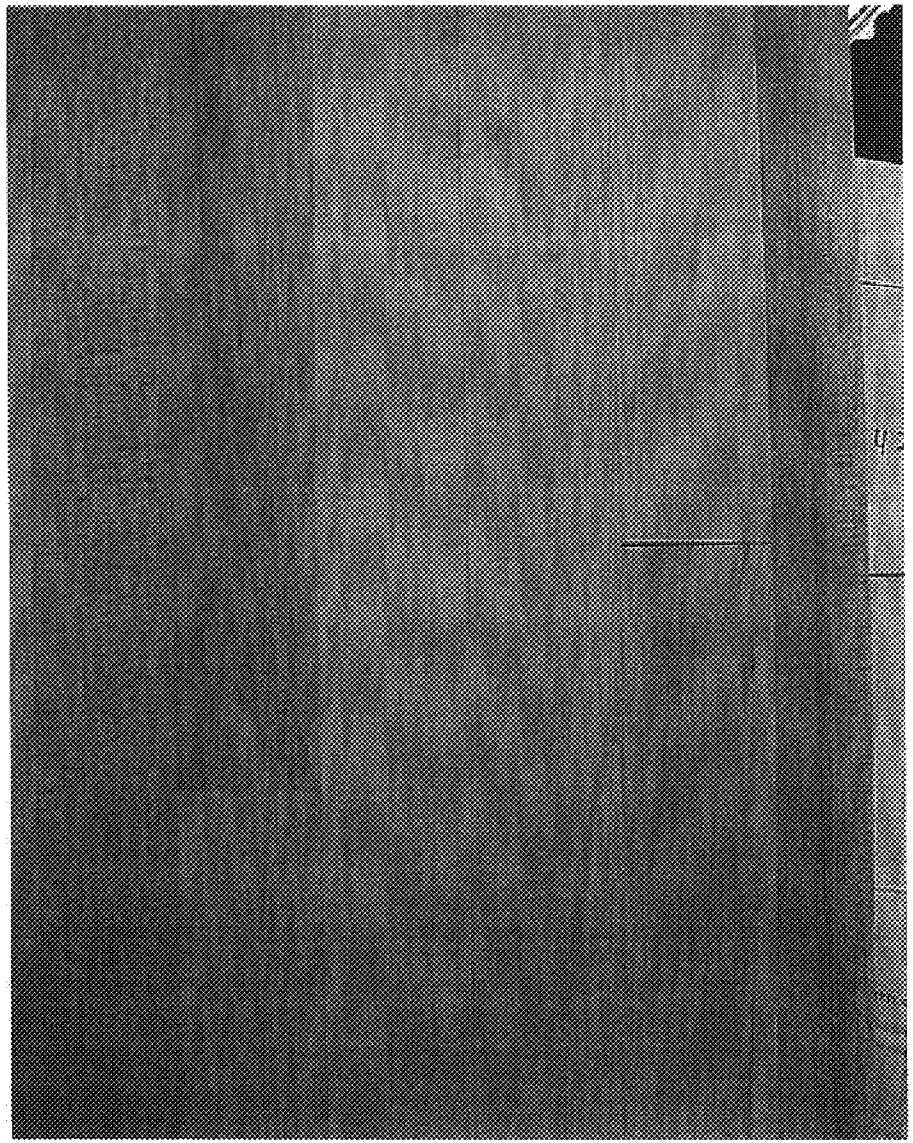
FIGURE 5b (PRIOR ART)
Figure 6A:
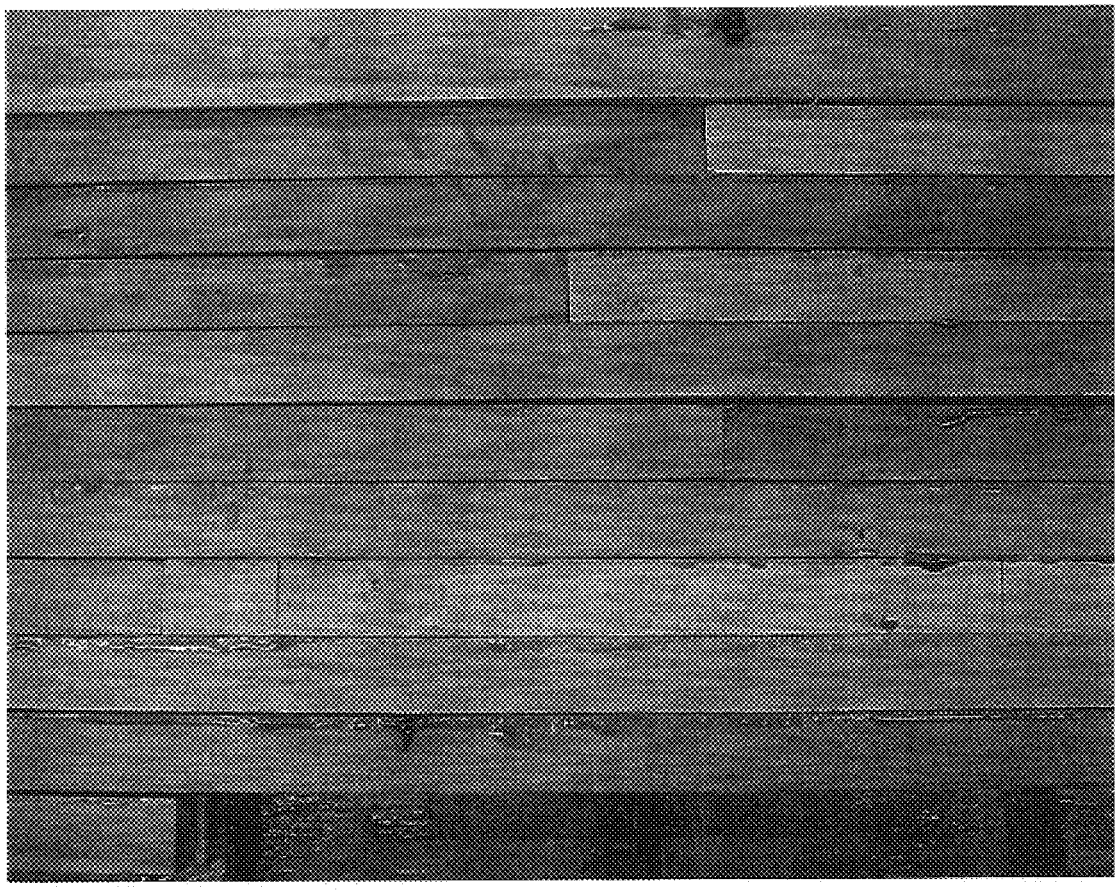
FIGURE 6a (PRIOR ART)
FIGS. 6*a* and 6*b*, identified as Prior Art, are photographs showing an assembled truck trailer floor before it goes into the press.
Figure 6B:
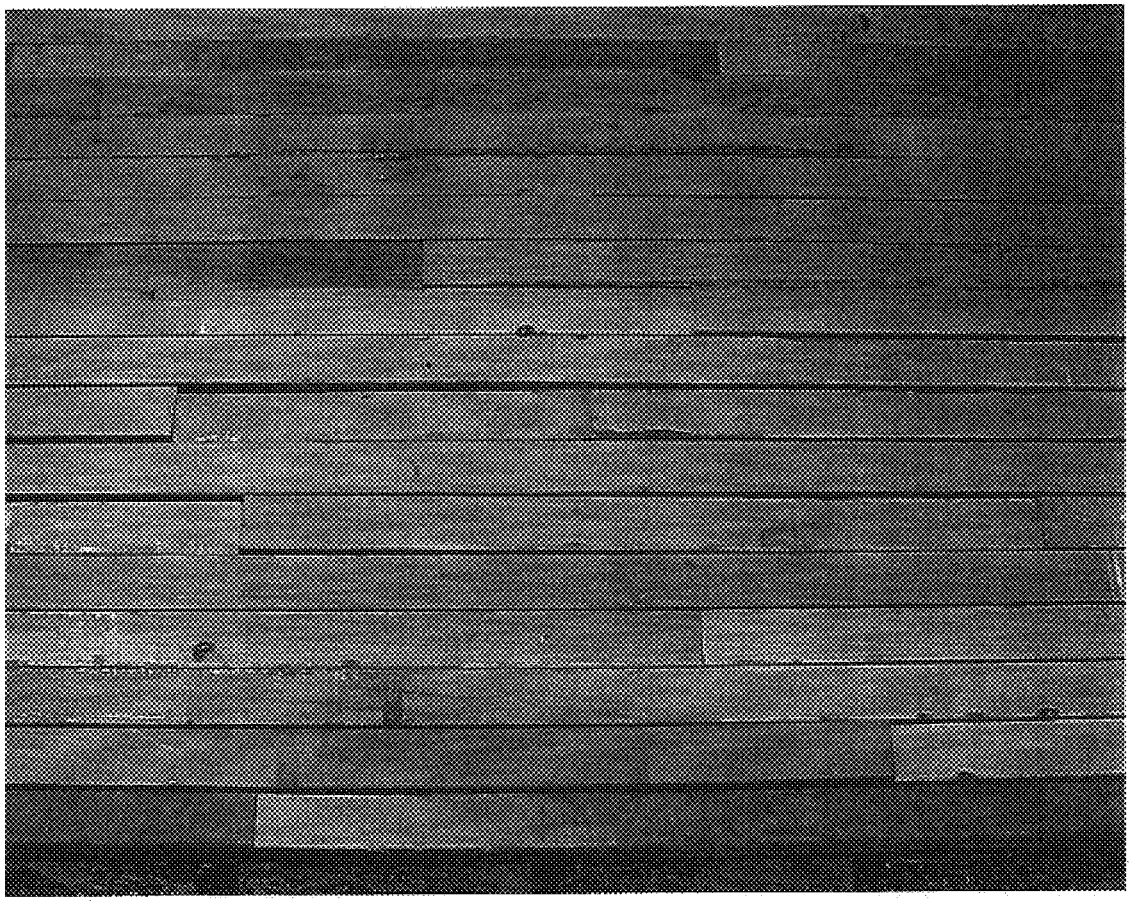
FIGURE 6b (PRIOR ART)
Figure 7:
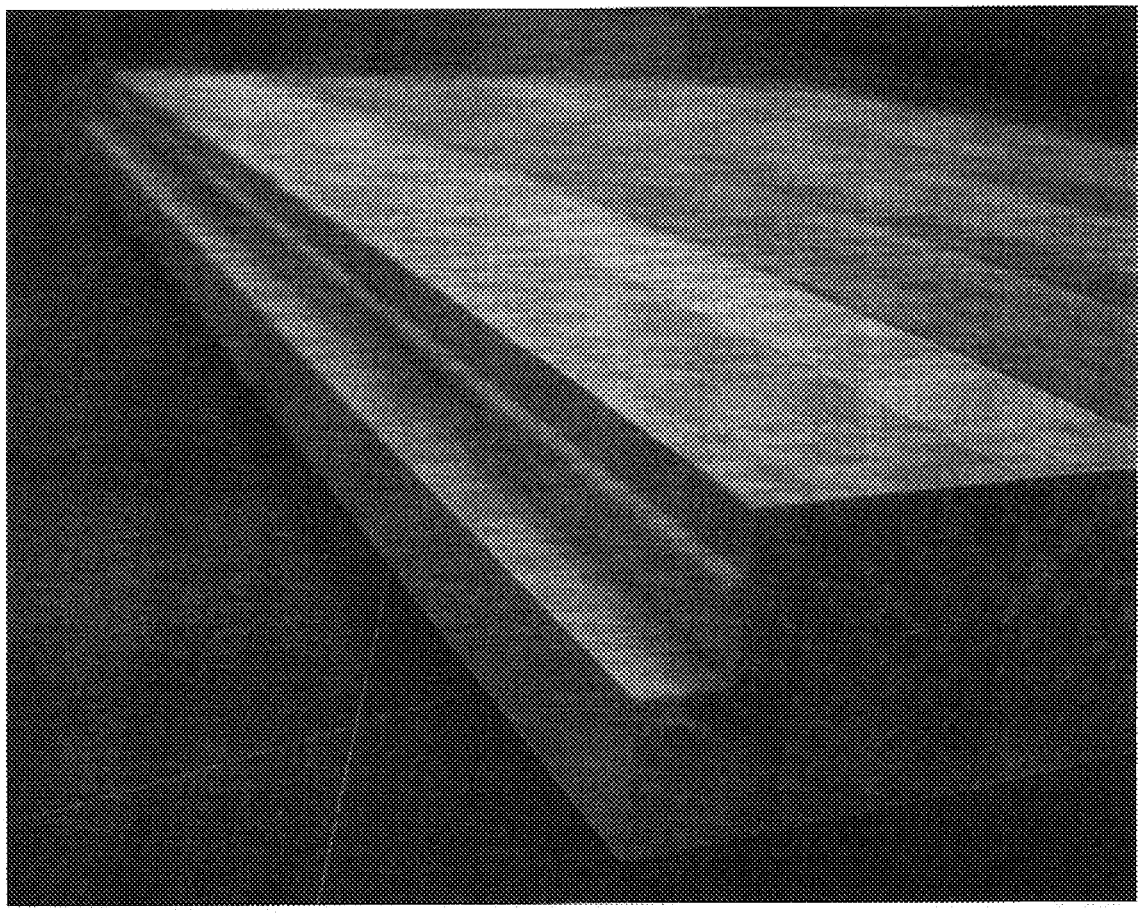
FIG. 7 is a photograph of a shiplap of a trailer or container floor.

To alleviate the above-mentioned problems, a novel joint and a new production equipment and method was designed, tested and refined to improve over conventional wood flooring. The new wood flooring is essentially the same as that of the conventional wood flooring except for the design of the joint, and the equipment used to produce it. The new joint, designated as a finger joint, is highly resistant to the passage of water, seals the bottom of the wood member and solves the problem of leaky hook joints. Also, the finger joint improves the mechanical properties of the flooring and therefore the thickness of the laminated wood can be reduced. Thus, thinner and lighter wood flooring can be produced with equivalent strength when compared to thicker conventional wood flooring. Since the finger joint provides a dramatic diminution of the "pop-out" of lumber strips, the fatigue resistance of the wood flooring can be improved over that of the conventional wood flooring.

Initially, in other wood industries, finger joint technology was developed to reduce the loss of the wood and increase the length of a piece of wood. Over the years, the value of the wood increased and longer and wider boards were becoming rarer every day. It thus became necessary for the wood industry to use the finger joint to maximise the use of the wood. Essentially, finger joint technology permits the use of short pieces of wood to transform them into a long piece of wood. In other words, finger jointing produces a piece of wood which has essentially the properties or characteristics of a piece of clear un-jointed wood. All the equipment developed until now had as its purpose the ability to make a finger joint on both ends of short pieces of wood, put glue into the finger joint, bring the pieces behind each other into a conveyor, apply pressure to press one piece into the next one tightly and cut at the desired length. Depending on the glue used, the strip stayed pressed until the glue reaches its full strength. The longer strip was finally planed or used in its final application.

Actual techniques and jointing equipment are designed to manufacture only one strip at a time. This joint technique cannot be used for manufacturing truck trailer and container floors. In fact, the control of the distance between joints and quantity of joints per square foot is essential in the truck trailer floor manufacturing industry. The manufacture of one strip length at a time and then proceeding to assemble them into a press will randomize the distance and the distribution of the joints on the floor, with no control over the distribution of the joints and the distance between the joints. The only way to control the distance and distribution of the joints is to first proceed with the panel's assembly and then, simultaneously, to the jointing of all strips. The present invention addresses this issue and has required the development of the design of the joints and also the development of new equipment, which permits the simultaneous multiple jointing of a board.

Joint

The prior art joint, shown in FIG. 1, has a <<hook>> form. As mentioned hereinabove, the joint's form is strictly for facilitating the manufacturing of a floor and reducing production costs. The truck trailer and container industry is using this hook joint for this feature, i.e. "pulling" at the strips together. The hook joint is not ideal for maximising the strength and the durability of the floor.

Figure 8:
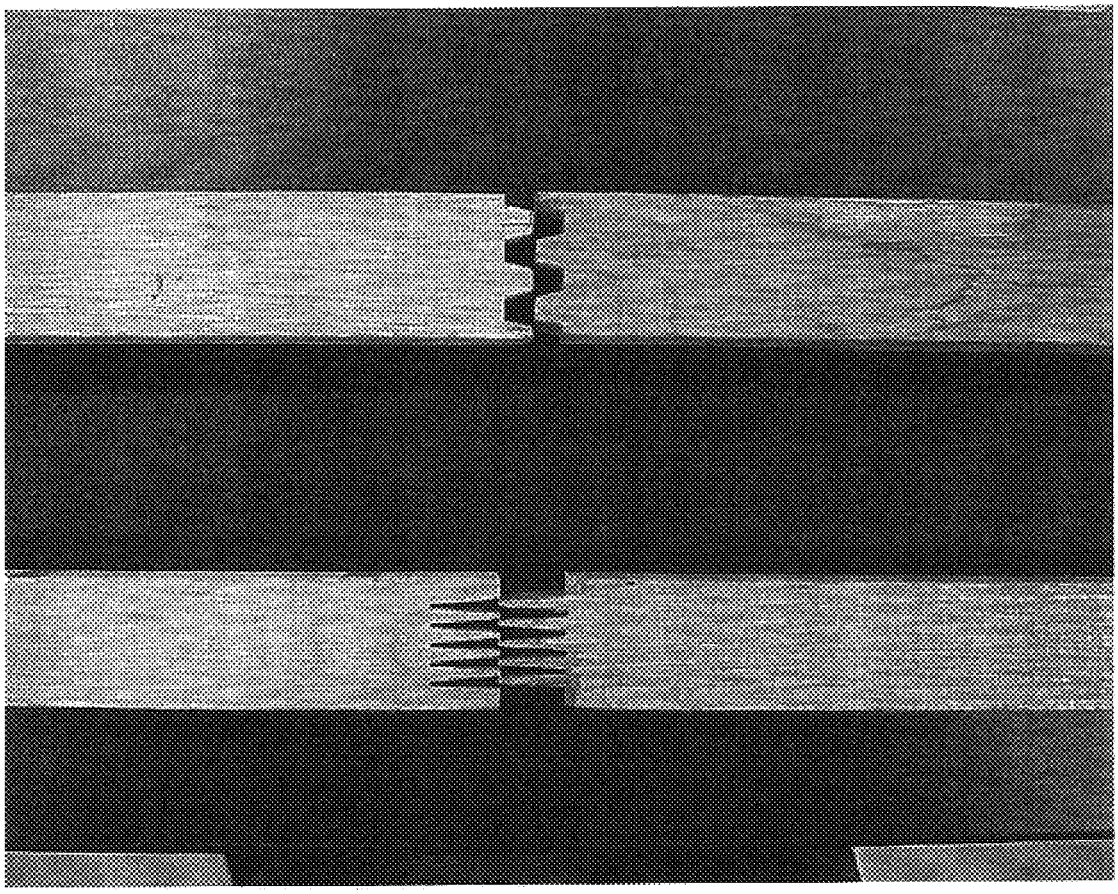
FIG. 8 is a photograph showing the new joint (top) and an example of one of the finger joints used by the moulding or furniture industry (bottom)
Figure 9:
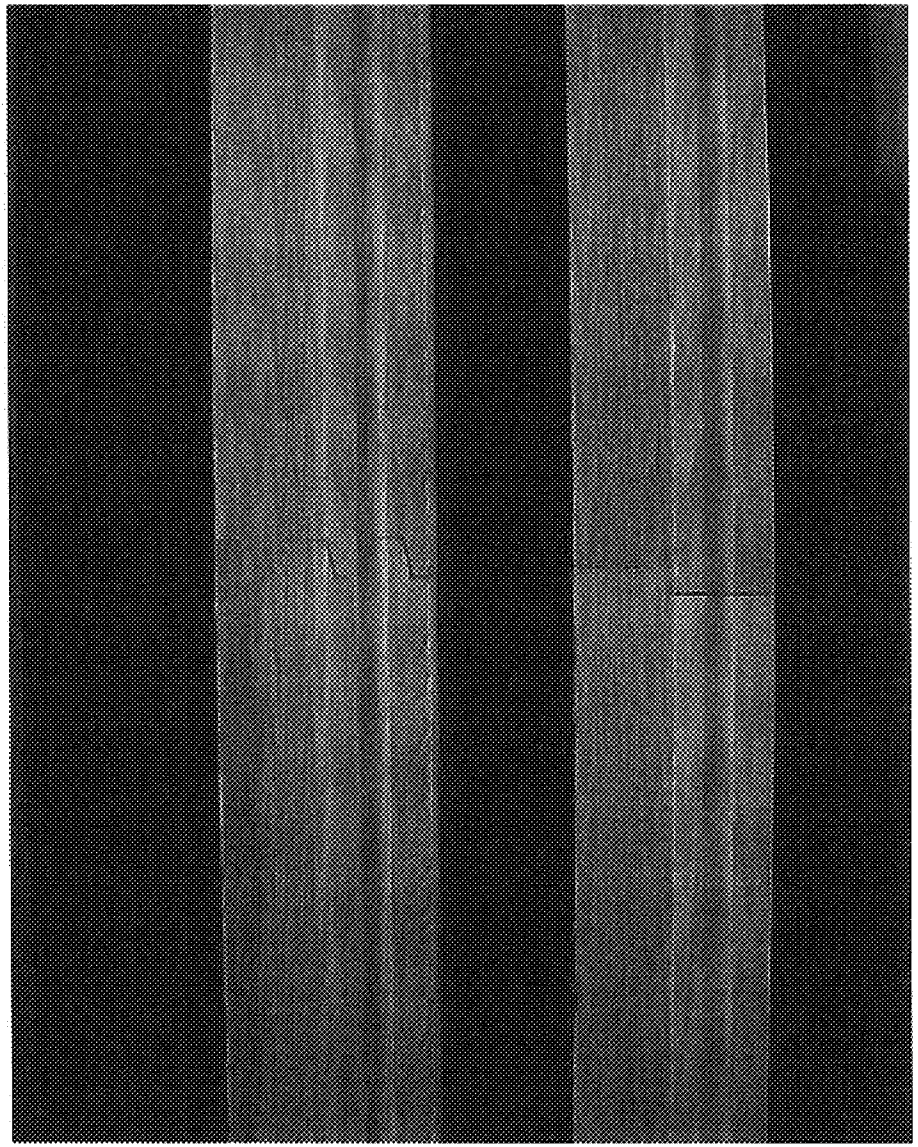
FIG. 9 is a photograph showing a side view of a shiplap in a board made according to the prior art (top) and the present invention (bottom)
Figure 10A:
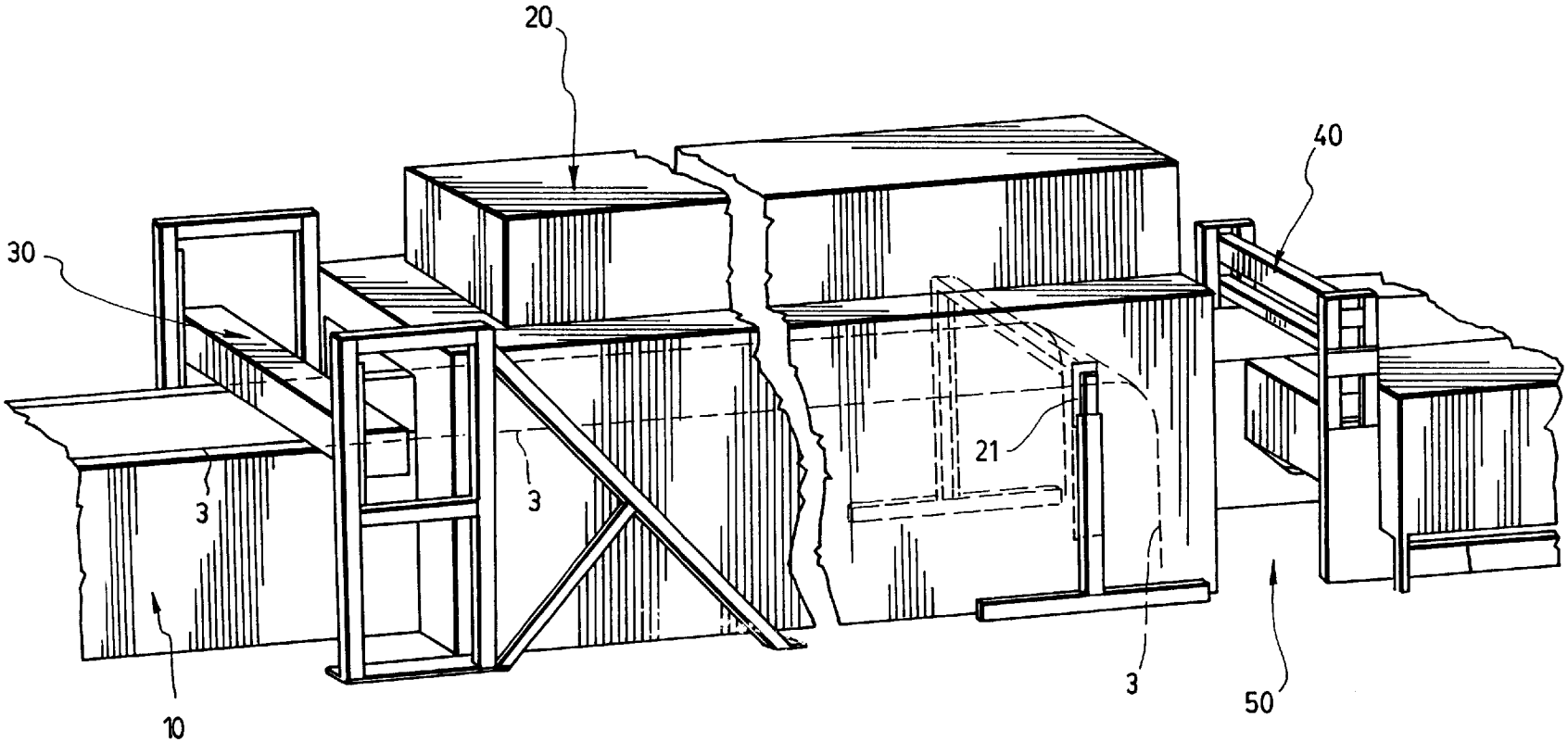
FIGS. 10*a*, 10*b*, 10*c* and 10*d* are schematic representations of a press according to the present invention, where
Figure 10B:
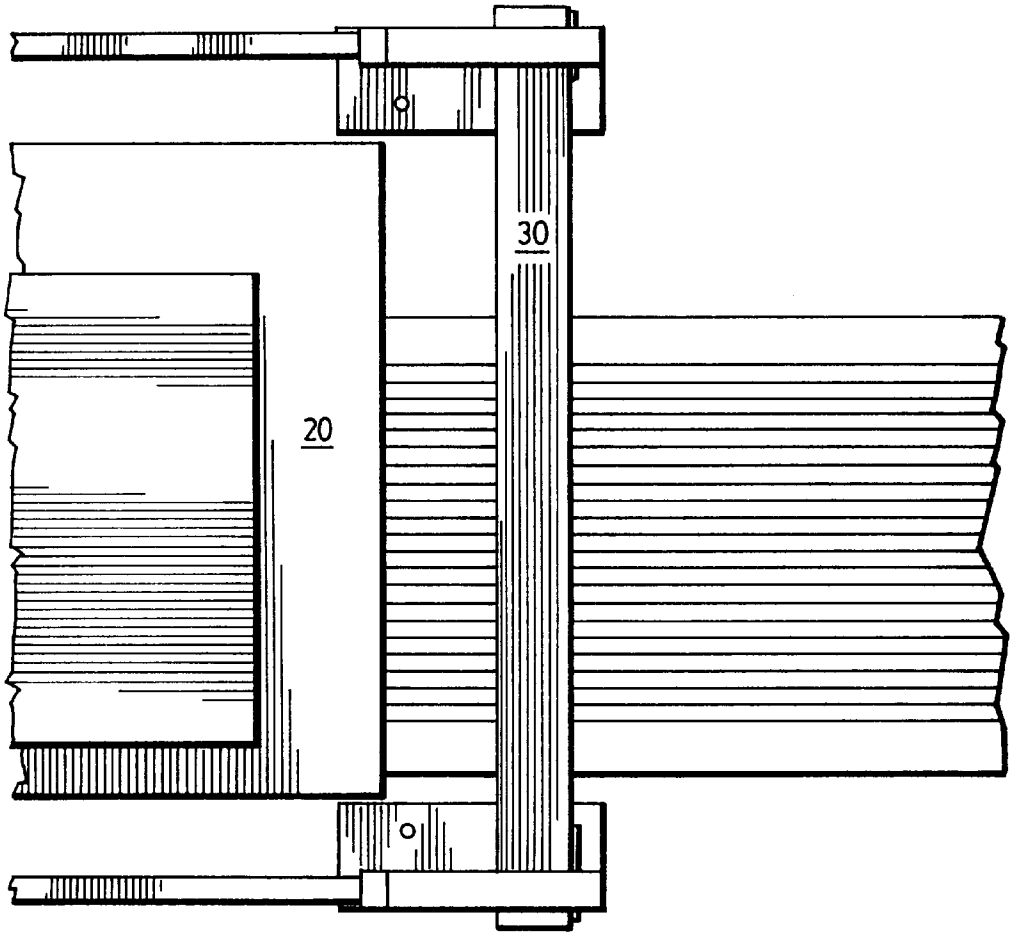
Figure 10C:
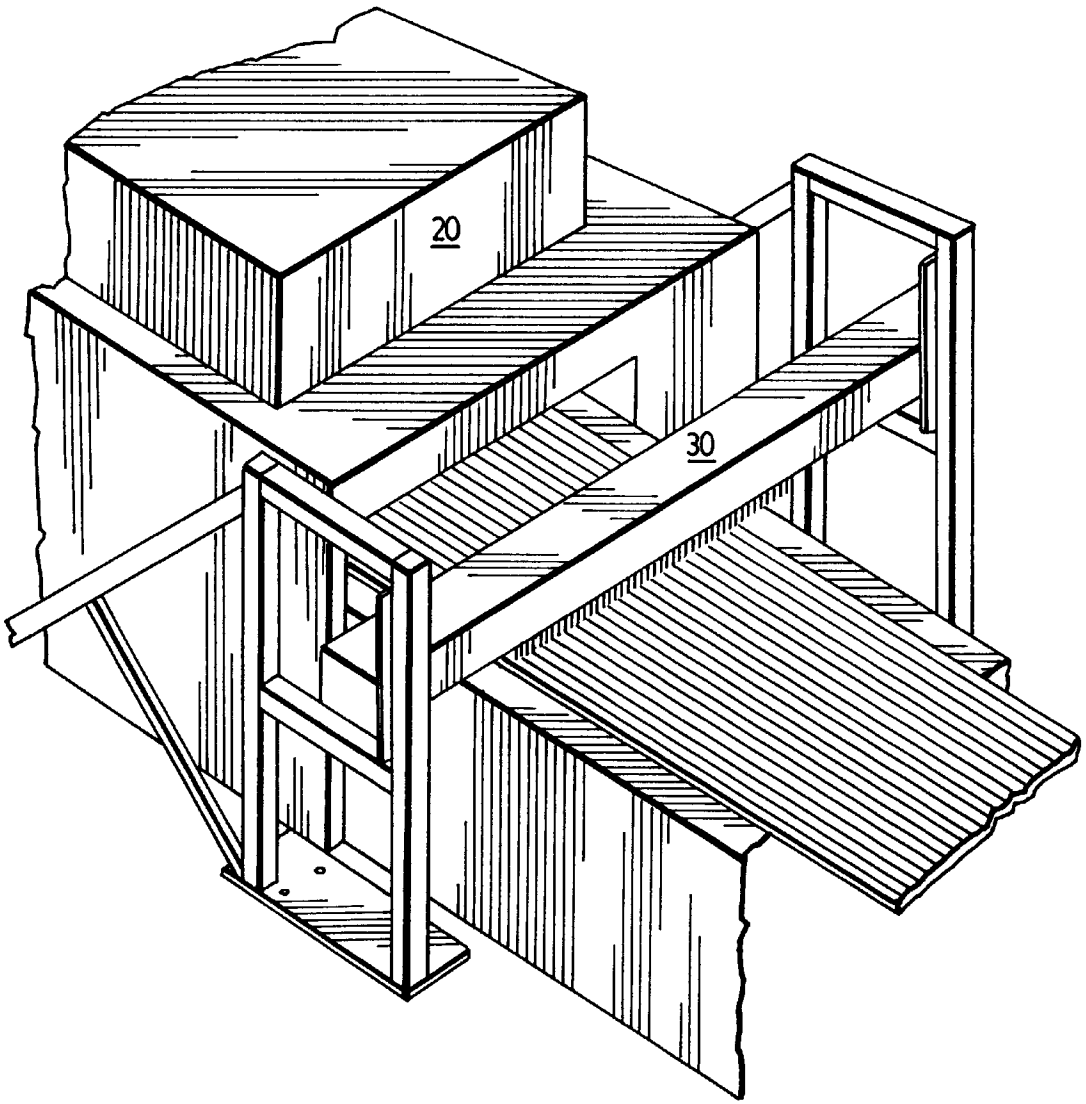
Figure 10D:
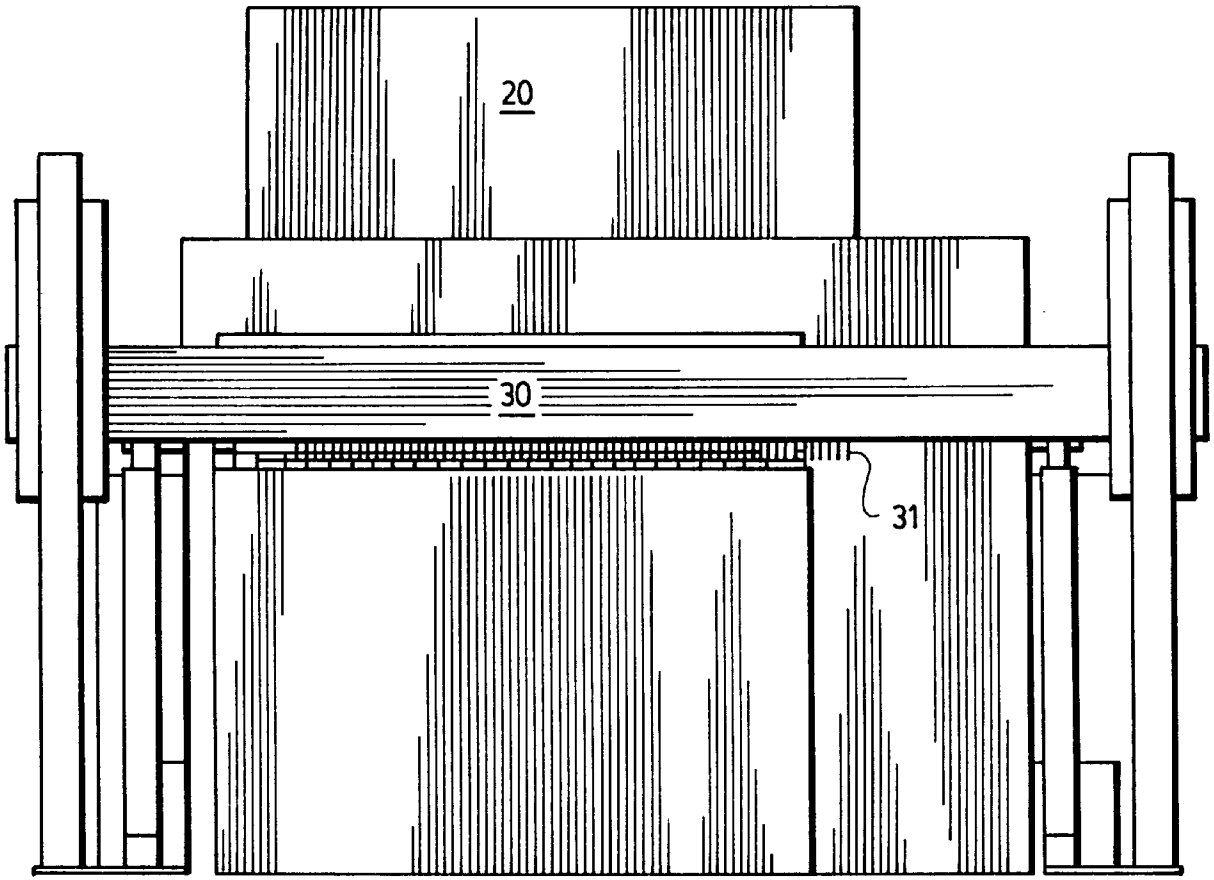

The new design in finger joint according to the present invention optimises the properties of a trailer's floor. The design of the finger joint is not like other finger joint normally used in the finger joint industry (bottom of FIG. 8). The finger was developed according to the particularity of the production process of the trailer floor and the trailer floor itself. The fingers of the joint for the trailer floor are shorter and thicker (top of FIG. 8). Since the pieces of wood are assembled by hand, bigger fingers are necessary to ease the connection of a piece of wood behind another. In fact, the angle of those fingers are as important as the size of the finger. The design also takes into consideration the fact that a complete finger (tongue and groove) needs to be in the ship lap. This will make the ship lap ledge stronger and more efficient to prevent the water from introducing itself (FIG. 9). Bigger fingers strengthen the finger to reduce breakage when the pieces are assembled. Finally, the fingers are preferably deep enough to optimize the mechanical strength of the joint and at the same time not too deep to increase the loss of the raw material. In a preferred embodiment of the invention, the fingers have a length between 0.15 and 1.5 inches, and the ratio of the base to the end of the finger is preferably greater than 1.8. This ensures that the fingers are wide and long enough to facilitate assembly.

In a typical plant, the manufacturing of the joint is made at the jointer, at the same place where the hook joint is presently manufactured. The jointer is modified to allow the production of the finger joint. Depending on the desired strength of the fingers, glue can be applied between them. The glue will enhance the structural force of the floor. The application of glue into the finger joint will increase the strength of the floor but, so it is not necessary, but optional.

Process and Manufacturing Equipment

Glue is applied on one or both sides of the piece of wood once jointed. They are then jointed by hand side-to-side in rows and one behind another on a conveyor at an assembly area 10. In general, an assembled panel has 48 to 65 individual strips wide, each being 0.5 inch to 1.5 inches wide and generally at least 6 inches long. It will be understood that other sizes fall within the scope of the present invention. At this point, the assemblers control the distance between joints and their distribution. Once one section is assembled, it is moved forward into the press 20 (FIGS. 10*a*, 10*b*, 10*c* and 10*d*). At this point, joints have a tendency to open because the strips are not provided with a hook joint at their ends. Inside the press, a device termed multi-finger joint pressing machine 30 closes the joints by applying an individual longitudinal pressure of more than 100 pounds on each strip. This process is called the multiple simultaneous jointing. It is multiple because there is more than one strip and simultaneous because a longitudinal pressure is applied to all strips at the same time. The multiple simultaneous jointing starts as soon as the panel is completely inside the press and follows these steps (see FIGS. 10*a*, 13*a*, 13*b* and 13*c*):

It should be noted at the outset that the length of a completed floorboard is generally longer than the length of the press.

Thus, the assemblers first assemble the leading portion of the floorboard. Once assembled, the leading portion is conveyed into the press. Inside the press, there is a stopper 21, which acts to stop only the leading edge of the floorboard from moving downstream. Once the leading portion has been assembled and cured and the leading portion moves beyond the press into a receiving area 50, a holding system 40, sandwiches the floorboard between the plate/rod and the conveyor, to prevent any longitudinal movement. This holding system is preferably a plate moveable between a retracted position and an operative position.

Figure 11A:
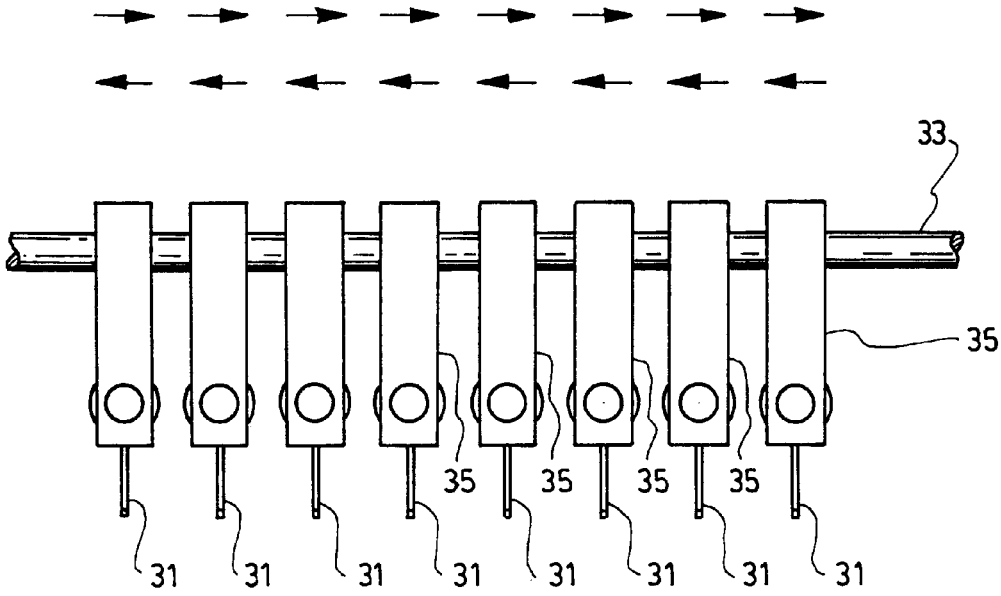
FIGS. 11*a* and 11*b* are partial views of the multi-finger joint pressing machine according to a preferred embodiment of the invention showing the holders and the teeth.
Figure 11B:
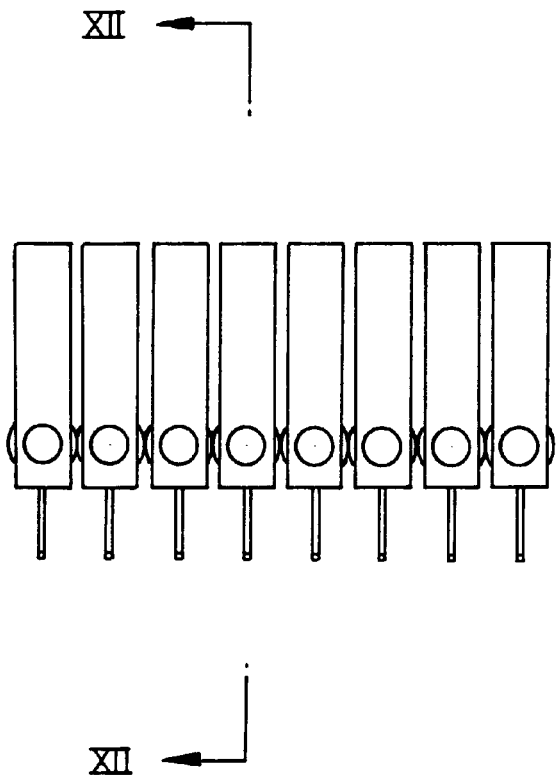
Figure 12:
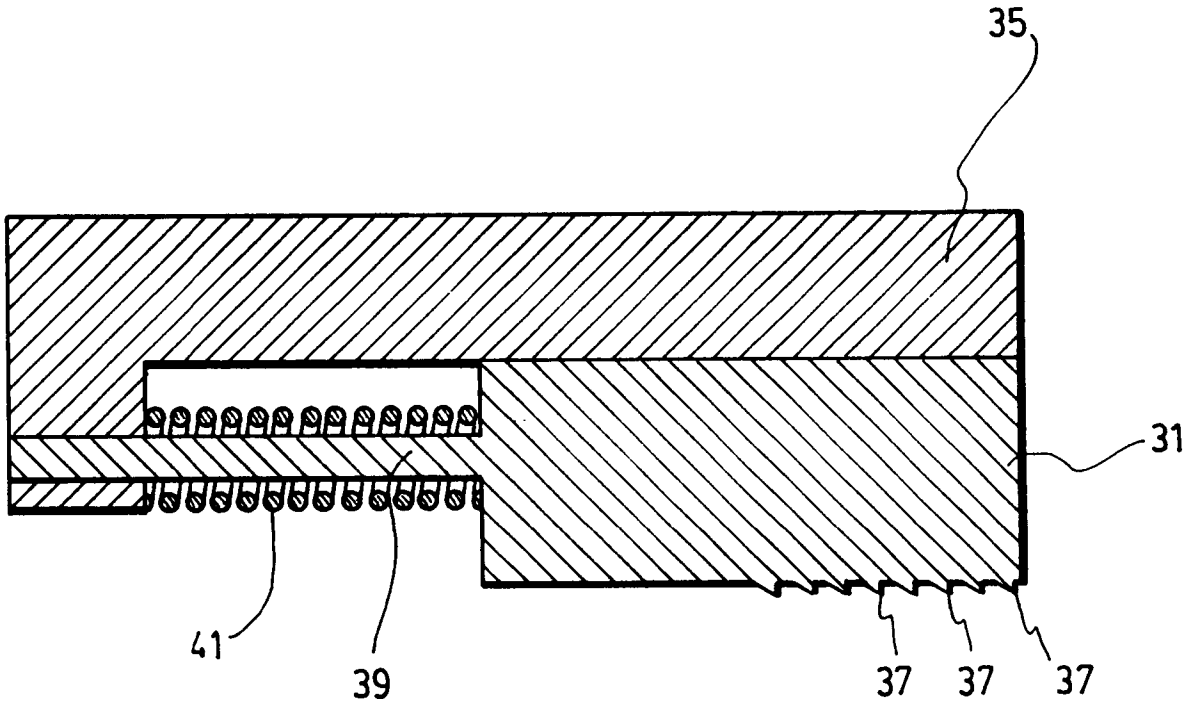
FIG. 12 is a partial side view taken along line 12—12 of the fingers of the multi-finger joint pressing machine of FIG. 11.
Figures 13A, 13B, 13C:
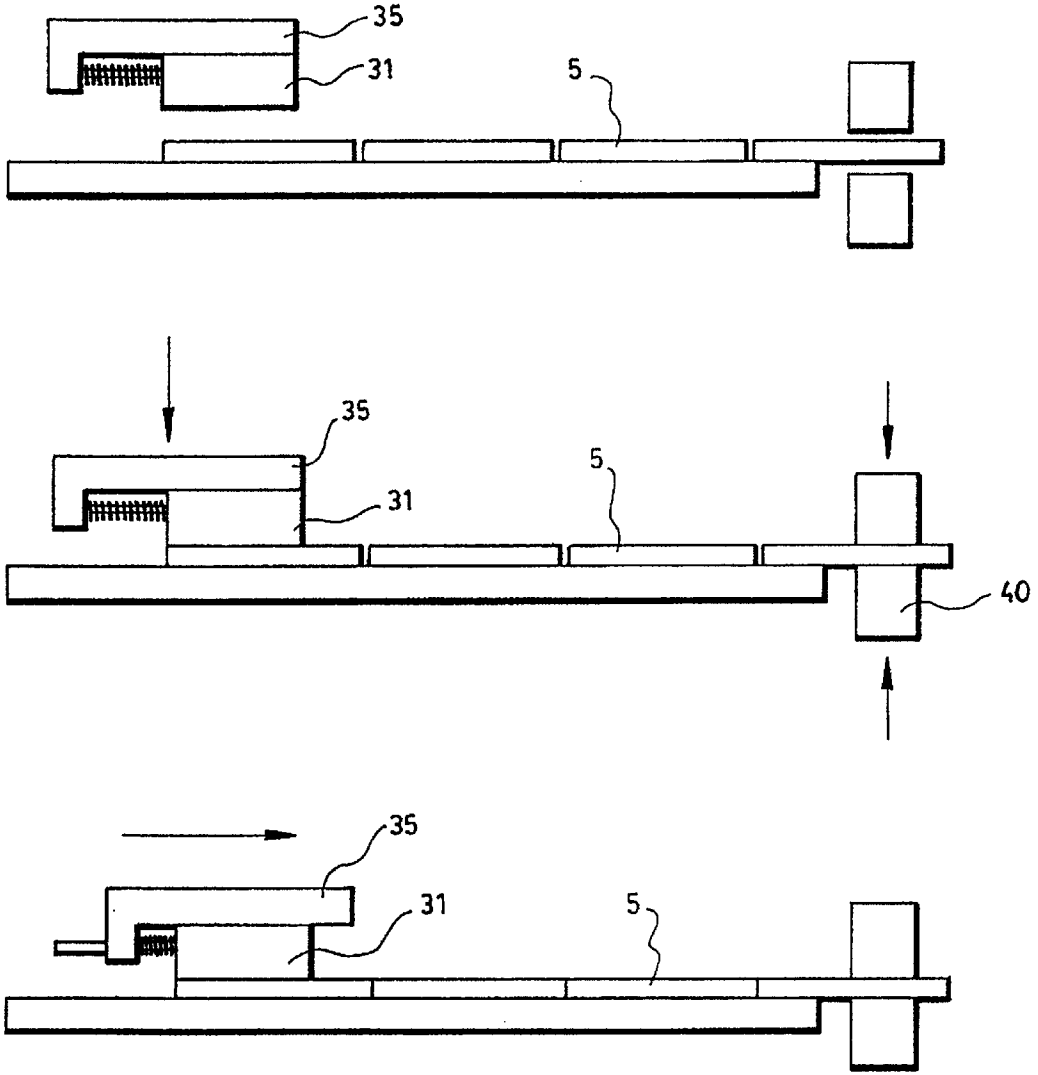
FIGS. 13*a*, 13*b* and 13*c* are, respectively, schematic representations of the multi-finger joint pressing machine shown in 13*a* in the retracted position, and in 13*b* and 13*c* in the operative position.

At the front of the press, either when curing the leading portion of the floorboard, or when curing other portions of the floorboard, the device 30 goes down on the panel's surface in a way that teeth plunge onto each strip of the panel 5. The joint pressing machinery has a rod or shaft 33 which is horizontally and vertically movable. The rod 33 holds holders 35, which are preferably laterally movable (see FIG. 11*a*). The holders 35 each support at least one tooth 31. The tooth is, in a preferred embodiment, a thin rectangular plate, having at least one pick 37, but preferably more, on its bottom edge (see FIG. 12). The holder preferably has an L-shape, and the front portion extending downwardly is provided with a longitudinal hole or slot. The tooth 31 has a forwardly extending shaft 39 which is partially inserted into the hole. Between the holder 35 and the tooth 31 and about the shaft 39, an energy absorber in the form of a spring 41 is placed. The energy absorber, as better shown in FIG. 13*c*, acts to absorb excess pressure so as not to damage the floorboard 5 when pressure is longitudinally applied.

It should be noted that the above description of the joint pressing machine 30 is preferential, and that variations in the materials, construction, components, etc. fall within the scope of the invention. What is important is a device, or means, which applies individual pressure to each of the strips during the curing process to close the joints properly. (To ensure good pressure and to be sure that all open joints will close, there is preferably at least one metal tooth for each strip composing the panel. Because the strips do not have always the same width and will not be at the same place in the conveyor, it is preferable for the holder to be laterally moveable to ensure that each tooth is aligned with the middle of each strip. This is important to ensure a good grip and reduce the quantity of glue. It should be noted that other solutions were tried to apply pressure, such as using rubber fingers, rubber teeth or other systems, but metal teeth were found to be the most efficient way to ensure good grip and pressure.)

Once the purchase on each strip is secured, the multi-finger jointing machine moves toward the back of the press and thereby applies an individual longitudinal and downward pressure on each strip.

The pressure will force the strips to nest one with another, closing the finger joints very tightly. (Each metal strip is preferably provided with a pressure absorber, such as a spring or piece of rubber, or any other pressure absorber. When all the joints are closed, the spring will start to contract. This is necessary to prevent the metal picks from scratching the surface of the strip. See FIGS. 13*a*, 13*b* and 13*c*).

Once this process is over, the press 20 begins the glue's baking or curing process. In the press, a large plate is lowered on the floorboard, and a lateral pressure system applies lateral pressure to downwardly and laterally apply pressure. This type of press is known in the art, and therefore specific details of its construction are not shown.

The pressure is released when the curing process is over or just after the pressure was applied; the multi-finger jointing machine is moved to the retracted position, and the holding system re-opens (either the stop inside the press or the holding system outside the press).

The curing being over, the press 20 opens and the conveyor 3 exits the cured panel and brings into the press 20 the next portion of the panel to be cured and the process starts over.

It is also understood by persons skilled in the art that an appropriate controller controls the apparatus of the press, the multi-finger jointing machine 30 and the conveyer. It will also be apparent to a person skilled in the art that the specific construction of the holder 40 is not an essential element of the present invention. Furthermore, the components which move the multi-finger jointing machine from its retracted position to its operative position, although preferably being pistons appropriately placed, could be other known or unknown systems, as will be apparent to those skilled in the art. Also, although the motion of the transversal bar is illustrated as following an "L" shape, such motions could be different provided that the pressure is applied downwardly and longitudinally to close the joints, but does not promote buckling of the floor.

Preliminary Test Results

Several production tests were done with the new equipment and the new joint. Results have met expectations.

First, the new the new multi-finger joint pressing machine closes the joint better. Previous floors had only 35% to 50% of the joints closed tightly. With the new multi-finger joint pressing machine, 90% to 100% of the joint are closed tightly, reducing dramatically the quantity of the putty used to fill the gaps.

Second, fatigue tests were performed to see if the floor had a better capacity to spread the load and thus, was stronger than a floor using a hook joint. Again, results have met expectations. In fact, a fatigue test was performed with a load of 13 000 pounds. Usually, a floor with hook joint will reach between 15 000 to 17 000 cycles before failing. A floor with the joint of the present invention was tested. After 20 000 cycles the floor did fail. Another test was done with 16 000 pound loading. Usually a floor with a hook joint will reach between 4 500 to 6 200 cycles before failing. A floor with the joint of the present invention was tested. The floor failed after 9 200 cycles. It is approximately a 50% increase comparatively to a conventional floor using hook joint. These tests show that the new joint, process and equipment increase the strength of the floor and its moisture resistance.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A method of manufacturing a floorboard comprising the steps of:

(a) providing a plurality of wood strips, each of said wood strips having two opposite ends, each of said ends being provided with spaced apart fingers;

(b) applying an adhesive to facing sides of adjacent wood strips;

(c) assembling said wood strips longitudinally to form joints between two wood strips and side by side in rows to form said floorboard, said step of assembling further including the step of controlling a distance between successive joints and a distribution of joints in a given area;

(d) conveying said floorboard into a curing area;

(e) applying longitudinal, vertical and lateral pressure to said floorboard to press the rows of wood strips against each other and to close the finger joints when said floorboard is said curing area;

(f) curing said floorboard and (g) removing said floorboard from said curing area.

* * * * *